US005415321A

United States Patent [19]

Gehlert et al.

[11] Patent Number: 5,415,321

[45] Date of Patent: May 16, 1995

[54] FEEDER FOR PHARMACEUTICAL THERMOFORM PACKAGING MACHINES

[75] Inventors: Klaus E. Gehlert, Holland; John W. Waitz, Bensalem, both of Pa.

[73] Assignee: Gemel Precision Tool Co., Inc., Ivyland, Pa.

[21] Appl. No.: 139,281

[22] Filed: Oct. 19, 1993

[51] Int. Cl.[6] ..... B65G 59/00

[52] U.S. Cl. ..... 221/68; 221/95; 221/200; 221/264

[58] Field of Search ..... 221/68, 93, 95, 174, 221/200, 264

[56] References Cited

U.S. PATENT DOCUMENTS

| | | | |
|---|---|---|---|
| 2,385,311 | 9/1945 | Strauss | 221/68 |
| 3,526,743 | 9/1970 | Spisak | 221/68 |
| 4,101,284 | 7/1978 | Difiglio et al. | 221/95 |

FOREIGN PATENT DOCUMENTS

| | | | |
|---|---|---|---|
| 346475 | 6/1960 | Switzerland | 221/93 |
| 1227414 | 4/1986 | U.S.S.R. | 221/264 |

OTHER PUBLICATIONS

Aylward Enterprises, Inc.: GMP Feeder.

Uhlmann: The Right Way in Blister-Packaging.

*Primary Examiner*—H. Grant Skaggs

*Attorney, Agent, or Firm*—John J. Simkanich

[57] ABSTRACT

An apparatus for feeding a plurality of pharmaceutical product simultaneously onto a matrix of formed blister webbing is provided. The dedicated feeder structure is held within a housing which incorporates a plurality of hanger plates for easy manual exchange and replacement of the feeder component subsystems called "change parts". These components include a reciprocating bin carried on a platform for simultaneously delivering a plurality of product in a desired matrix format. A plurality of entrance chutes, assembled into the matrix formation simultaneously feeds the product downward from the bin. A horizontally operated shuttle gate having a plurality of product orifices operates to simultaneously open and close each chute and to transfer the respective matrix of product to a release guide structure which may be implemented as a template or a plurality of release chutes. The release guide structure feeds the matrix of formed blister webbing. Entrance chute, shuttle gate and release guide structure surfaces which can or may contact product are preferably contoured in crossection to conform to product shape and coated or plated with a friction reducing surface to promote steady and continuous product movement or flow. Bin movement is accomplished by reciprocating motion provided by a crank shaft drive structure which operates in a sealed enclosure. This structure lifts and lowers a platform which carries the bin. A pair of juxtaposed slide bars operating on respective spaced apart and aligned shafts carry the shuttle gate.

20 Claims, 6 Drawing Sheets

FEEDER FOR PHARMACEUTICAL THERMOFORM PACKAGING MACHINES

BACKGROUND OF THE INVENTION

The present invention relates to a feeder subsystem for delivering a matrix of product to a pharmaceutical blister package loading station, which station is part of a packaging system. This pharmaceutical product includes tablets, capsules, caplets, liquid gel caps and the like. The invention specifically relates to such a feeder which simultaneously delivers a gated quantity of said products in a two-dimensional matrix format at said blister packaging station.

Pharmaceutical product feeders generally have a receiving container or bin; a discharge mechanism for moving product from the bin; a distributor structure for aligning a quantity of product in the intended package formation (or matrix); and a product control structure for depositing the required number of product (one or more) at each desired package location in the proper timed sequence.

Higher volume packaging systems require higher volume feeders. This higher volume is achieved in part with line filling/feeding (i.e. "l" by "n" matrix) or with matrix filling/feeding (i.e. "n" by "n" matrix). The feeder's fill control structure, which performs the gating function, is timed to the operation of the packaging system. Pneumatic and electric motor drives have been incorporated into such feeders.

Uhlmann Packaging Systems A.G. of Laupheim, Germany, and Aylward Enterprises, Inc. of New Bern, N.C., are among manufacturers who have provided product feeders for blister packaging systems in the past. These feeders have utilized a number of design approaches including roller feeders, flood feeders, carousel feeders and sieve feeders.

Regardless of the approach to the above-recited feeder designs, each feeder unit has many design dimensions, curvatures and other measurements and shapes specific to a particular product it is to handle. When the product size, shape, weight and surface characteristics are changed, different feeder specifications are needed to handle the different product.

These feeders in general have incurred several shortcomings. These shortcomings have included: a) a lack of ease of disassembly for cleaning or jam clearing; b) product hang-ups which are sensitive to speed of operation; c) an inability to changeover for various products or an excessive down time for changeover; and d) undesirable service life.

What is desired is a feeder structure which is durable and which has an extended service life.

What is further desired is such a feeder structure which is easily disassembled for cleaning and jam clearing and which is capable of component changeover for different product handling.

What is even further desired is such a feeder structure which is less sensitive to speed of operation and wherein product hang-ups are less likely to occur with increased speed of operation.

SUMMARY OF THE INVENTION

The features of the present invention are realized in a feeder for simultaneously delivering a plurality of pharmaceutical products to a formed blister webbing loading station in a matrix format. The dedicated feeder has a rectangular housing which has four fixed side walls, an open bottom and an open top. This housing is fixedly positionable above and approximate to the blister package loading station. A pivot hinge structure which includes a pressurized piston and a three position detent lock plate may be incorporated onto the housing to allow it to rotate away from the loading station, to lock it in the rotated position, or to lock it into a position approximate the loading station.

Mounted onto the opposing inside faces of a first pair of the housing side walls is a pair of shaker mechanisms, each being mounted to one respective wall. Each mechanism is enclosed in a rectangular-like enclosure so that its outside wall defines the ultimate respective inside face of the product handling portion of the housing.

Each shaker mechanism is identically structured and contains a rotatable crank shaft positioned horizontally therein to extend through one wall of the enclosure and the side wall of the housing. The crank shaft carries a pair of identical but spaced apart crank offsets. A drive pulley or gear is mounted on the protruding end of the crank shaft. Each crank shaft for each shaker mechanism (crank mechanism) is driven to operate in unison. Typically, each crank shaft drive pulley or gear is rotated continuously. Alternately, an optional eccentric crank drive can be connected to the drive pulley to impart a variable reciprocating motion thereto.

Extending vertically through the top face of a crank housing enclosure is a pair of spaced apart operating rods. Each rod is coupled to be driven by a respective clam type rocker arm operating on a respective crank offset of the crank shaft. A bracket or foot plate is mounted to the upper ends of the pair of operating rods, which rods extend through and above the top face of the crank housing enclosure. When the drive pulley is caused to rotate continuously, the foot plate is caused to rise and fall. A separate foot plate is used for each crank mechanism.

A rectangularly shaped product bin holds a supply of product. This product bin has a plurality of openings on its bottom in the approximate pattern to the delivered matrix of the products. An entrance chute or tube is protruding through to each bin bottom opening. The plurality of these entrance chutes forms an upper staging area. (To be referred to as an upper staging area.)

A bin support plate is mounted between the two crank mechanism foot plates. The product bin is mounted to extend through this support plate and ride thereon. When the crank shafts are rotated, the operating rods reciprocate. The foot plates thereby move up and down in reciprocating motion causing the bin support plate and product bin to do likewise.

A pair of hanger plates can be secured to opposing inside faces of the housing occupied by the two crank mechanism enclosures. These hanger plates are channeled or otherwise machined to receive and hold a plurality of product chute structures. These chute structures provide a plurality of chutes to form the above-recited upper staging area in a matrix formation required for the product delivery. The product chute structures are inserted and held in a receiving socket or slot in the hanger plate. In the alternative, the hanger plates may be secured to the crank housing walls.

A horizontally operating gate intercepts the path of the product chutes. This gate includes a rectangular, horizontally operating, shuttle plate with a plurality of orifices therethrough positioned in the pattern of the product matrix, each orifice being of a size to pass a single product at a time.

The shuttle plate is removably mounted to a pair of juxtaposed guided side bars. These side bars each operate within a respective cavity extending along an inside face of the housing. Each of the guided side bars is mounted on a pair of guides and are moveable into and out of the housing cavity with the first of said side bars being driven by a pneumatic piston or other means and the second being a follower side bar. This movement moves the shuttle back and forth across the housing cavity. Orientation can be in alignment with the travel of the product webbing or orthogonal thereto.

A template, or alternately, a plurality of release chutes form a lower staging or release area in the pattern of the product matrix. When release chutes are utilized, they form channels machined into plates mounted between the hanger plates. The release chutes connect the output of the shuttle plate to the loading station.

The entrance chute structures, shuttle plate and release chutes are easily manually removable and exchangeable without the use of tools. The entrance chute passageways, the shuttle plate orifices and other surfaces as well as the release chute passageways can be preferably contoured and coated or plated with a friction reducing surface to promote the steady and continuous flow or movement of product. Such friction reducing coatings or platings are presently available in the marketplace. These structures can be made of Federal Drug Administration approved metals or plastics. The coatings and plating are also selected from FDA approved lists.

DESCRIPTION OF THE DRAWINGS

The features, advantages and operation of the present invention will be better understood from a reading of the following detailed description of the invention, in conjunction with the following drawings, in which like numerals refer to like elements and in which.

DETAILED DESCRIPTION OF THE INVENTION

Figure 1:
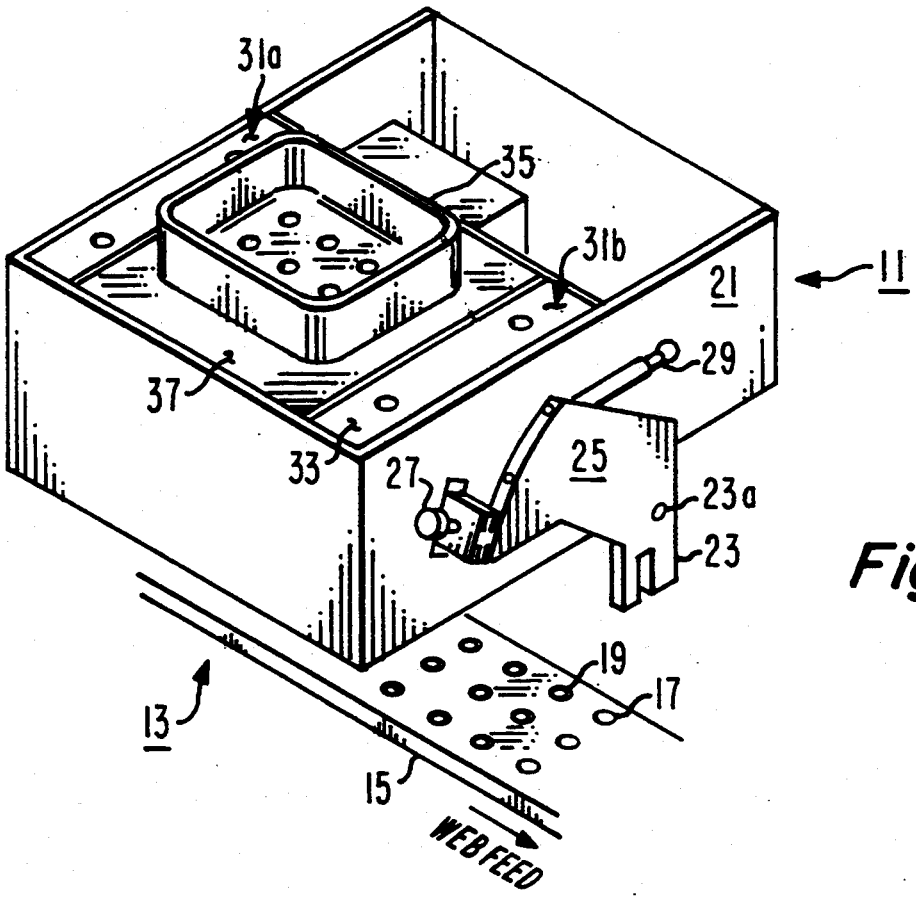
FIG. 1 is a perspective view of the feeder housing positioned over a blister package loading station.

A dedicated feeder structure 11 for supplying pharmaceutical product to a down line blister packaging station is mounted directly above a loading station 13 in relationship to intermittently moving thermoform blister webbing 15, FIG. 1. The output from the loading station 13 is a matrix of pharmaceutical products 19 which is packaged down line. The feeder 11 includes a rectangular housing 21 having four side walls and open top and bottom faces. This housing 21 is positioned over the blister webbing 15 above the loading station 13 and is oriented in alignment with the path of travel of the formed blister webbing 15 carrying the blisters 17.

A pair of bracket structures 23 carry a pivot hinge 23*a*, 23*b* (not shown), respectively, on either side of the housing 21. A detent lock plate 25 is mounted to each side of the housing 21 and allows the housing to be tilted up and back, away from the loading station 13. Each lock plate 25 carries a detent pin for locking the housing 21 down over the loading station 13 or at its pivoted position away from that loading station. A bi-directional pressure cylinder (piston) 29 assists in the rotation of the housing 21 against its weight. This structure will be discussed in further detail below.

A pair of crank mechanism rectangular enclosures 31*a*, 31*b* are mounted along opposing inside walls of the housing 21. A moveable foot plate 33 extends along the top of each crank mechanism enclosure 31*a*, 31*b*.

A product bin 35 rests on top of and is supported by a bin support plate 37 which extends between the foot plates 33 across the width of the top of the housing 21. One embodiment of this product bin 35 can be better seen in FIG. 2.

Figure 2:
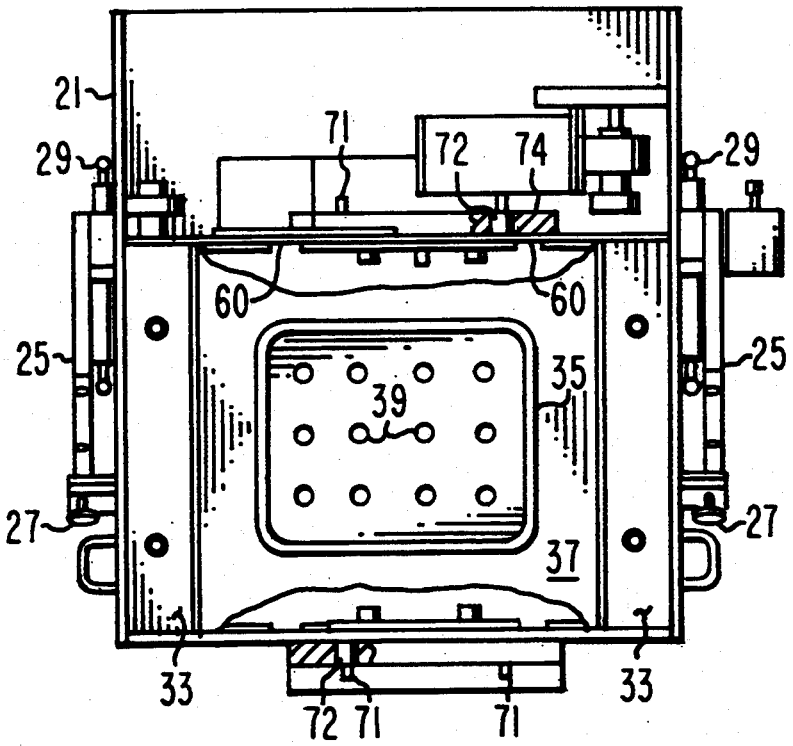
FIG. 2 is a top view of the feeder housing of FIG. 1 showing a first embodiment of the product bin and a first orientation for the staging chutes and crank housings.

The product bin 35 is rectangular in shape, FIG. 2, and carries a plurality of openings (orifices) 39 in its bottom. These openings allow the products 19 to drop from the bin 35 when it is vibrated by means of the motion of the foot plates 33 acting upon the bin support plate 37.

Figure 3:
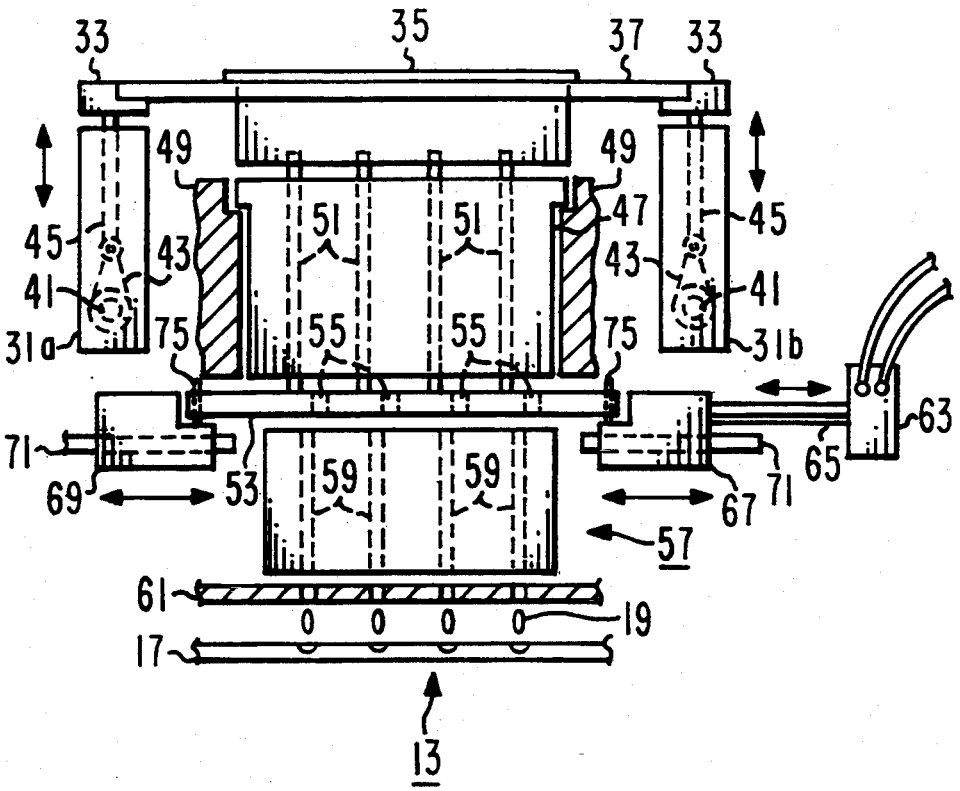
FIG. 3 is a block diagram of the feeder showing the principal functional components.

FIG. 3 shows the principal functional components of the feeder 11 in a block diagram format. Absent from this figure are the walls of the housing 21. Crank mechanism enclosures 31*a*, 31*b* each contain a horizontally extending crank shaft 41. These crank shafts 41 are driven to rotate in unison. Positioned on each crank shaft 41 is a pair of clam-type rocker arms 43. These rocker arms 43 are rotated by a crank offset (shown below) in the crank shaft 41.

A pair of operating rods 45 are connected, one each, to each rocker arm 43 and extend vertically through the top of the crank mechanism enclosure 31. The respective foot plate 33 is connected to the free ends of the respective pairs of operating rods 45 extending through the top of the enclosure 31 to ride above the enclosure 31. As the crank shafts 41 are rotated, the operating rods 45 move in a reciprocating motion causing the respectively connected foot plate to rise and fall, thereby shaking the bin support plate 37 and the bin 35.

A plurality of plate structures 47 are slidably mounted between paired juxtaposed hanger plates 49. These hanger plates 49 are mounted to opposite walls of the housing 21. Alternately, these hanger plates 49 can be mounted to facing walls of the crank housing enclosure 31. The hanger plates 49 are machined to carry receiving slots, dowel holes or other indentations for slidably receiving and holding the plate structures 47.

Machined, or otherwise formed in each plate structure 47 is a plurality of channels or slots to form the entrance chutes 51. These entrance chutes 51 are intended to carry the product 19 downwardly from the bin 35 toward the loading station 13. This plurality of entrance chutes 51 forms an upper staging area. The pathway of each chute 51 will depend upon the individual product 19 intended to be handled.

A shuttle gate structure is implemented by a reciprocating horizontally operating rectangular shuttle plate 53. This shuttle plate 53 gates off each of the entrance chutes 51, when in a second position called the release position, and allows but a single product 19 to drop when in a first position, called the home position. This single product gating function is determined by: a) the orientation of each product 19 as it comes out of each entrance chute 51; b) the size of each product; and c) the size of an orifice through the shuttle plate 53; as well as, d) the thickness of the shuttle plate at the orifice location.

Shuttle plate 53 contains a plurality of orifices 55, one for each entrance chute 51. When the shuttle plate 53 is in its release position, the entrance chutes' 51 bottom ends are closed off. When it is in its home position, the bottom ends of the entrance chutes 51 open onto the respective openings or orifices 55 of the shuttle plate 53.

The shuttle plate 53 rides on the guided slide bars 67, 69 between the upper and lower staging areas 47, 57. The paths of the entrance chutes 51 and the release chutes 59 are offset from each other and the shuttle plate 53 reciprocates between their positions, first accepting product, then releasing it.

The lower staging area 57, which carries the plurality of release chutes 59, is slidably mounted within the housing 21 in positioning slots 60 (not shown in FIG. 3 but shown in FIG. 2) in the front and rear housing walls adjacent the hanger plate 49 walls. This arrangement allows the template or lower staging chutes 59 to be easily removed separately from the underside of the housing 21 facilitating the quick product clearing.

The rectangular shuttle plate 53 carrying the plurality of orifices 55 in the matrix formation for the blister package 17 is caused to operate in its reciprocating motion by a bi-directional pneumatic piston 63. The output shaft 65 of this piston 63 is connected to drive the first guided slide bar 67. This guided slide bar 67 operates horizontally in a plane extending a limited distance from the wall of the housing 21. A follower guided slide bar 69 operates on an aligned horizontal plane in a limited distance from the opposing wall of the housing 21. Each of the driven and follower guided side bars 67, 69 are mounted on a pair of guide pins 71 which slide on bushings 72 positioned in bushing blocks 74 mounted on front and rear housing walls. (Not shown in this FIG. 3 but shown in FIG. 2.)

Each guide slide bar 67, 69 carries an offset shoulder 73 for receiving one of opposing sides or edges of the shuttle plate 53. A pair of locating dowel pins 75 extend upwardly from the base face of the shoulder 73 so that the shuttle plate 53 is received down onto the pair of guided side bars 67, 69 and is held in position by the four locating dowel pins 75.

The template 57, or alternately the release chutes 59, terminate a sufficient distance above the formed blisters 17 to allow a short drop of each product 19 at the loading station 13. The individual entrance chutes 51, forming the upper staging area, extend above the plate structures 47 as tubes for a sufficient distance to extend through the bottom of the bin 35 and into the bin 35 cavity when the bin travel is at the bottom of its stroke. The stroke of the operating rods 45, which determines the amount of the lift of the bin 35, is a function of the crank offset on the crank shaft 41 and the proportions of the rocker arms 43. A variable stroke may be achieved by an optional eccentric crank drive discussed below. The design speed of operation, i.e. the rotating speed of the crank shafts 41 as well as the throw (or through motion) of the operating rods 45, is governed by the particular product 19 being handled and is variably adjustable. A support 61 can be used to hold the lower staging chutes 59 in position within the housing 21.

Figure 4B:
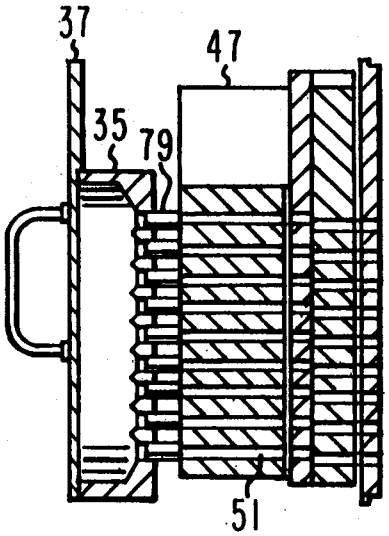
FIG. 4*b* is a 90 degree rotated crossectional view of the product bin of FIG. 4*a*, the upper staging chutes directly below the bin and extending through each bin bottom opening and the reciprocating gate (shuttle plate) below the upper staging chutes.
Figure 4C:
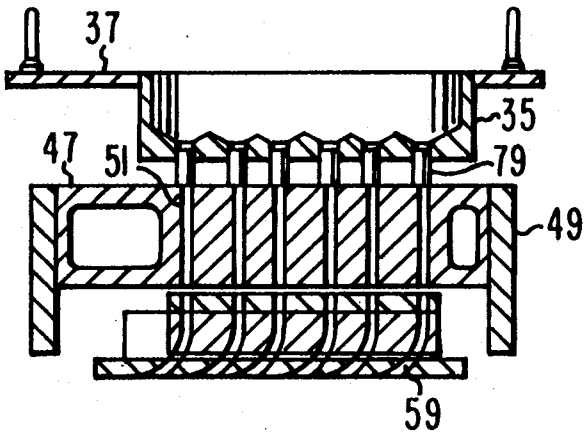
FIG. 4*c* is a crossectional view of the product bin, upper staging and shuttle plate of FIG. 4*a* and FIG. 4*b* taken from a viewpoint orthogonal to FIG. 4*b;*
Figure 4A:
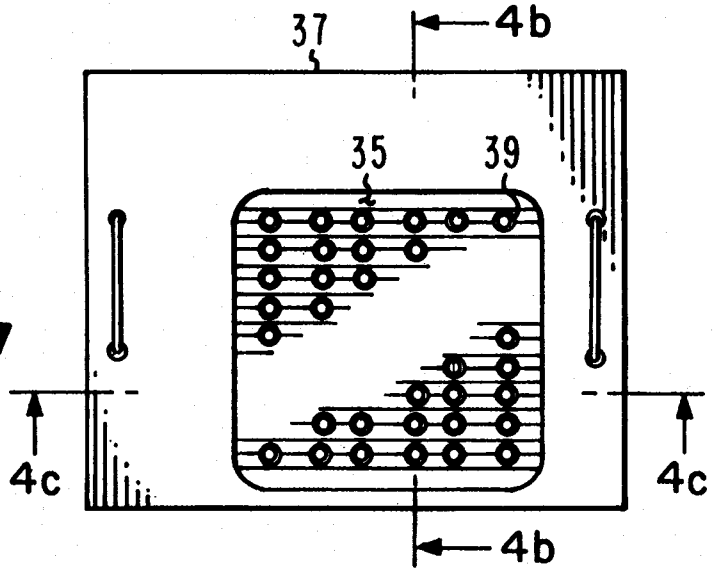
FIG. 4*a* shows a top view of a second embodiment of the product bin, bin bottom opening pattern and bin support plate.

FIGS. 4*a*, 4*b* and 4*c* show the change parts which are removable in subassemblies from a housing. FIG. 4*a* shows a top view of a second embodiment for the product bin 35 with a further matrix pattern for the bin openings 39. This view, FIG. 4*a*, shows the adjoining walls of the housing 21 to be more equal in length than the embodiment shown in FIG. 2. These dimensions for the housing 21 walls will vary depending upon the manufacturer's respective model of thermoforming machine.

A rotated crossectional view, FIG. 4*b*, clearly shows the entrance chutes 51 extension nipples 79 which are of a length intended to extend into the bin 35 cavity as the bin support plate 37 rises and falls, thereby carrying the bin 35 with it. In this view, the driven guide slide bar 67 and follower guided slide bar 69 are also clearly shown (in side elevation) to operate in the same horizontal plane.

This embodiment, as seen in FIG. 4c, has the upper staging area entrance chutes 51 being straight and the lower staging area release chutes 59 curved in the direction of travel of the blisters 17 on the webbing 15. The choice of a straight or curved path is dictated by the product parameters.

Figure 5:
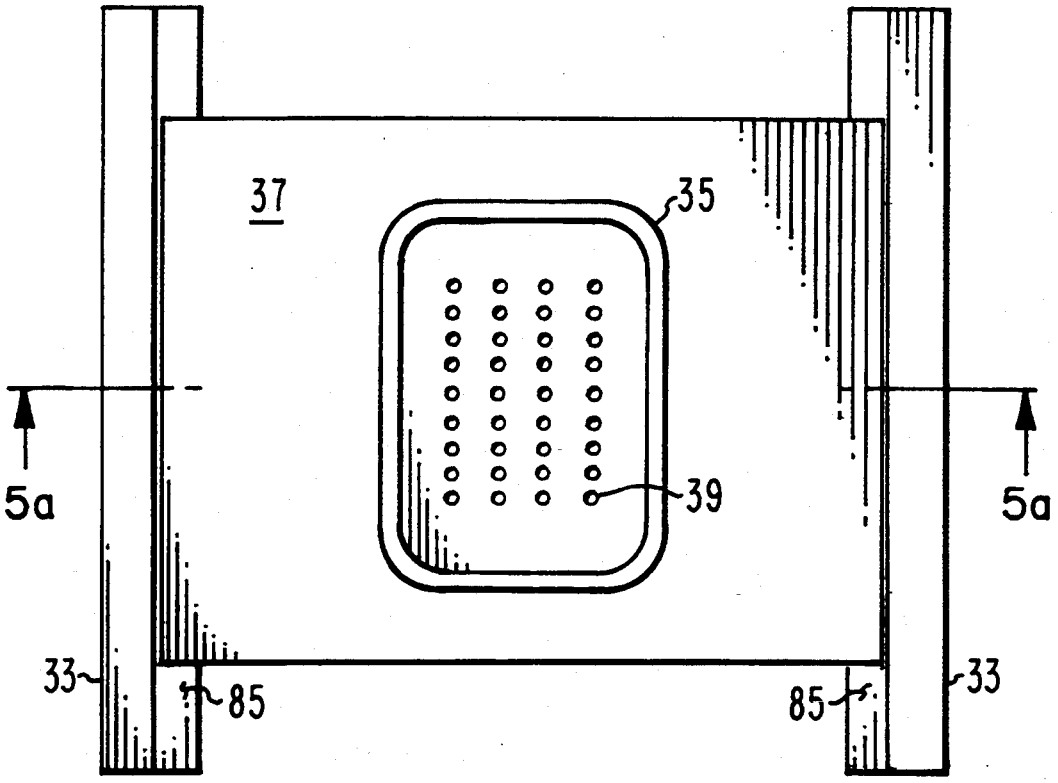
FIG. 5 is a detailed plan view of a third embodiment for the product bin, the bin support plate and the crank mechanism foot plate.

FIG. 5 shows a detailed plan view for a third embodiment for the product bin 35. The product bin 35 carries four rows of nine openings or orifices 39 through its bottom. The bin support plate 37 is attached to respectively facing shoulders 85 in each of the foot plates 33.

Figure 5A:
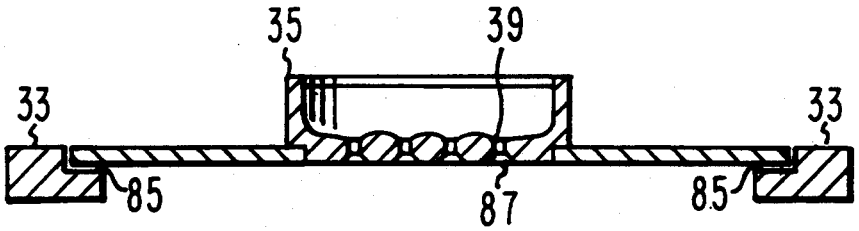
FIG. 5*a* is a crossectional view of the structure of FIG. 5 taken as shown in FIG. 5.

A crossectional view of the FIG. 5 structure can be seen in FIG. 5*a*. The bottom end of each bin orifice 39 is rounded or otherwise chamfered. This assists in the proper alignment of the product nipples 79.

Figure 6:
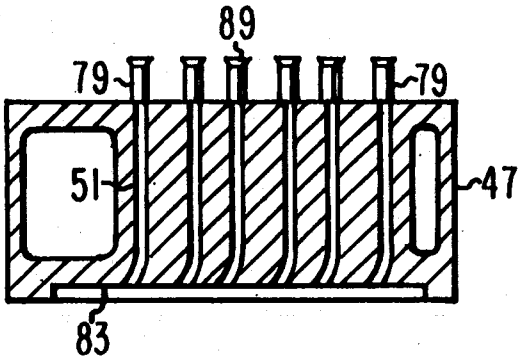
FIG. 6 is a partial crossectional detailed view of the upper stage chute block shown in FIG. 4*c;*

The plate structure 47 comprising the upper stage chute block seen in FIG. 4*c* is shown in detailed crossection in FIG. 6. Likewise, the nipples 79 which form the extensions of the upper staging entrance chutes 51 can be seen to carry slightly chamfered ends 89.

Figure 7:
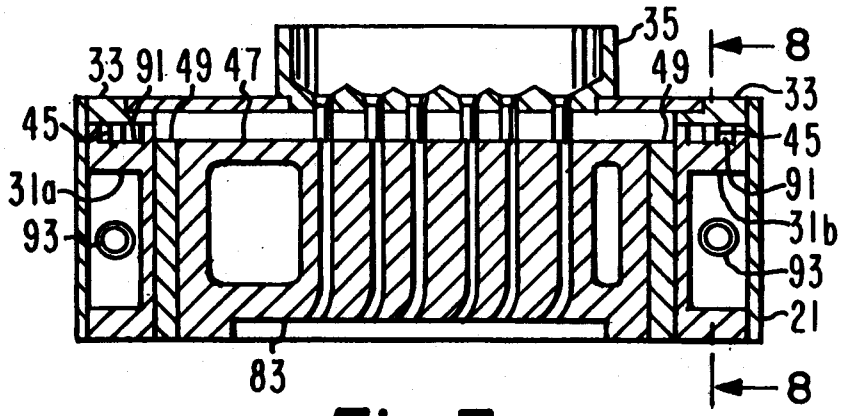
FIG. 7 is an expanded partial crossectional view of the upper stage chute block of FIG. 6 mounted between yoke plates positioned on the faces of juxtaposed crank housings.

FIG. 7 shows a crossectional view illustrating the upper staging plate structure 47 mounted onto receiving hanger plates 49 which are carried on respective facing walls of crank mechanism enclosures 31*a*, 31*b*. Supporting a respective plate 33 and extending outwardly from a respective crank mechanism enclosure 31*a* is the operating rod 45. In this embodiment the crank mechanism enclosures 31*a*, 31*b* have a recess 91 in their top into which the foot plates 33 retreat when the operating rods 45 lower the foot plates 33 and support plate 37. This allows for deeper penetration of the nipples 79 into the bin 35. The pulley 93 driving the crank mechanism is seen in end view.

Figure 8:
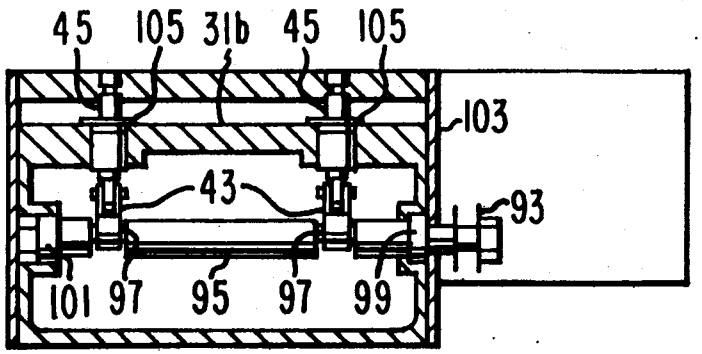
FIG. 8 is a partial crossectional view of a crank housing taken as shown in FIG. 7.

FIG. 8 shows an exploded view of the crank shaft 95 extending horizontally through the crank mechanism enclosure 31*b*. This crank shaft 95 carries a pair of spaced apart crank offset sections 97. The crank shaft 95 is supported at the wall of the enclosure 31*b* at its driven end by a first bearing 99 and at its opposite end by a second bearing 101. The shaft 95 extends through the back wall 103 of the enclosure 31*b* with its pulley 93 positioned on its extreme free end.

The rocker arms 43 are mounted on the crank offset sections 97 and connect to the operating rods 45. As each operating rod 45 passes through the upper wall of the crank mechanism enclosure 31*b*, it passes through a respective operating rod bearing 105. The operating rod bearings 105 can be self-lubricating sleeve bearings or another type of appropriate bearing structure which would allow for the reciprocating motion of the operating rods 45 for long life sealed operation.

Figure 9:
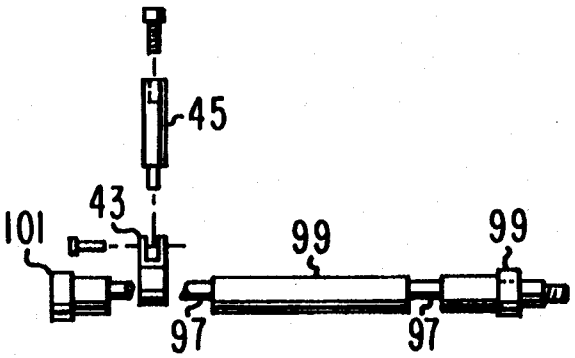
FIG. 9 is an exploded view of a crank shaft, clam rocker arm and operating rod of a crank mechanism housed in a crank housing.

An exploded view of the crank shaft 95, a mating clam rocker arm 43, and an operating rod 45 can be seen in FIG. 9. Also seen are the first and second crank shaft bearings 99, 101 which also are, preferably, permanently sealed.

Figure 10A:
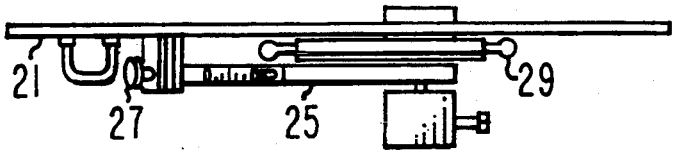
FIG. 10*a* is a top view of the pivot plate assembly taken as shown in FIG. 10.
Figure 10:
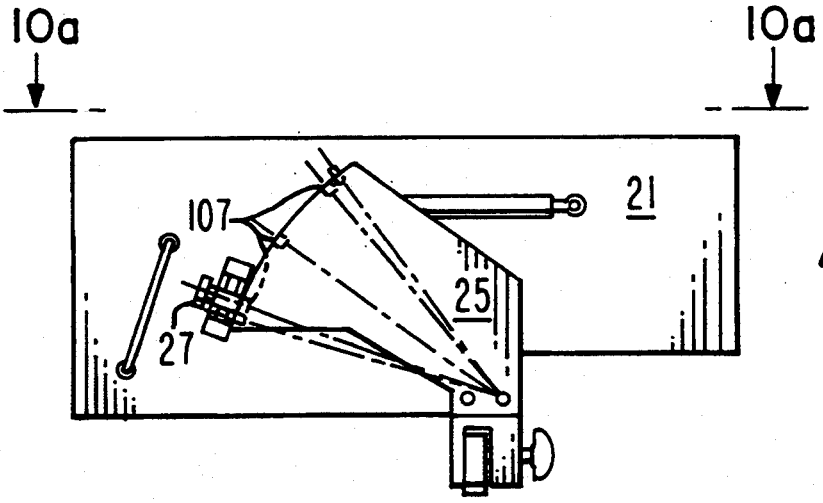
FIG. 10 is a side view of a detent pivot plate assembly for fixedly pivoting the feeder housing.

Another embodiment of the pivot plate 25 assembly can be seen in FIG. 10. This plate allows for a rotation of the housing 21 with respect to three fixed positions defined by a spring biased detent pin 27 which operates in three receiving bores 107. These receiving bores 107 establish the three locked positions for the housing 21, these being at approximately horizontal, 15 degrees and 30 degrees from horizontal over the loading station 13. The detent pin 27 as well as the bi-directional pressure cylinder 29 can be seen in relation to the detent locking plate 25 in FIG. 10a, a top view.

Figure 11:
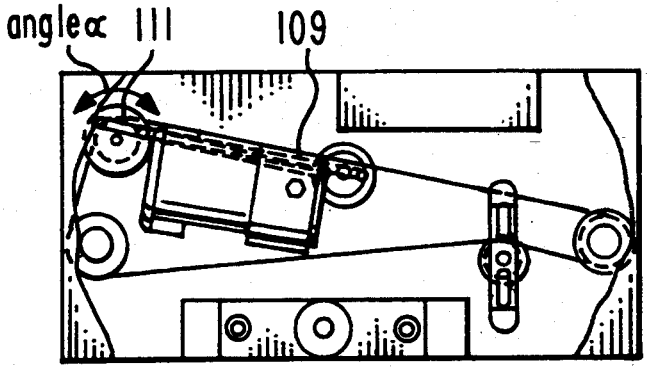
FIG. 11 is a side view of an optional eccentric crank drive for the crank mechanism.

An adjustable length reciprocating motion can also be imparted to the crank shaft 95 directly by an optional eccentric crank drive, FIG. 11. This is a double crank arm design. The link arms 109, 111 impart an arcuate reciprocating motion to the crank shaft 95 upon the rotating motion of a drive shaft. The extent of the arcuate rotation (angle of rotation) is a function of the placement of the pins holding the arms 109, 111.

The above design of the invention allows for ease of removal, manually, of the bin 35, the upper staging chutes 51, the shuttle plate 53, and the lower staging chutes 59 without the use of tools. Not only can these elements be easily and quickly removed, but other sized components can be exchanged, thereby greatly reducing down time in a line changeover.

Many changes can be made to the above-recited invention without departing from the intent and scope thereof. It is intended that the above description be interpreted to have been offered as illustrative of the invention and not be taken in the limiting sense.

What is claimed is:

1. A dedicated feeder for delivering product to a pharmaceutical thermoform packaging system loading station, comprising:

a housing positionable over said loading station;

a product bin located at the top of said housing and carrying a plurality of orifices in its bottom in a predetermined matrix pattern consistent with the established pattern for the delivery matrix of the product;

a mechanism for imparting a vertical reciprocating motion to said bin, said mechanism being enclosed in an enclosure;

at least one structural member containing a plurality of entrance chutes, said structural member being manually insertible and removable from said housing without the use of tools at a location adjacent to and immediately below said bin, and having entrance chutes extending from said bin orifices to guide product discharged from said bin, said entrance chutes remaining fixed without motion with respect to said bin motion;

a slidable gating and indexing plate moving to operate below said entrance chutes to close same off, said plate having a plurality of orifices therethrough to allow the discharge of a single product each and to index said product to a second position, wherein said plate is manually insertible to and removable from its operating area without the use of tools; and a release guide structure positioned immediately below said plate, said release guide structure having a plurality of orifices therethrough in the matrix pattern of the delivered product, said orifices guiding said product to fall to said loading station, wherein said release guide structure upper face operates with said plate in said indexing operation, and wherein said release guide structure is manually insertible into and removable from said housing without the use of tools and remains fixed without motion with respect to said bin motion.

2. The dedicated feeder of claim 1 also including a hanger structure attached to two opposing interior walls of said housing; and wherein said release guide structure is manually insertable into and removable from said hanger structure without the use of tools,

3. The dedicated feeder of claim 2 wherein said release guide structure is a template carrying a plurality of orifices, each said template orifice being aligned with a respective one of an intended product position of said loading station, said template remaining fixed to said hanger structure and said housing without relative motion thereto.

4. The dedicated feeder of claim 3 wherein the top face of said template Cooperates with said slidable gating and indexing plate to selectably release product to said loading station.

5. The dedicated feeder of claim 4 also including a second hanger structure attached to two opposing interior walls of said housing; and wherein said plurality of entrance chutes structure is manually insertable onto and removable from said second hanger structure Without the use of tools and remains fixed thereto.

6. The dedicated feeder of claim 5 wherein said plurality of entrance chutes each having an entranceway and an exitway are arranged in said predetermined matrix pattern; and wherein each said chute extends upward through a respective one of said product bin orifices to have its entranceway always within said product bin structure during said bin motion.

7. A dedicated feeder for delivering product to a pharmaceutical thermoform packaging system loading station, comprising:

a housing positionable over said loading station;

a product bin located at the top of said housing and carrying a plurality of orifices in its bottom in a predetermined matrix pattern consistent with the established pattern for the delivery matrix of the product;

a mechanism for imparting a vertical reciprocating motion to said bin, said mechanism including an enclosure;

at least one structural member containing a plurality of entrance chutes, said structural member being manually insertible and removable from said housing at a location adjacent to and immediately below said bin, and having entrance chutes extending from said bin orifices to guide product discharged from said bin;

a slidable gating and indexing plate operating below said entrance chutes to close same off, said plate having a plurality of orifices therethrough to allow the discharge of a single product each and to index said product to a second position, wherein said plate is manually insertible to and removable from its operating area;

a release guide structure positioned immediately below said plate, said release guide structure having a plurality of orifices therethrough in the matrix pattern of the delivered product, said orifices guiding said product to fall to said loading station, wherein said release guide structure upper face operates with said plate in said indexing operation, and wherein said release guide structure is manually insertible into and removable from said housing;

a hanger structure attached to two opposing interior walls of said housing and wherein said release guide structure is manually insertable into and removable from said hanger structure;

wherein said release guide structure is a template carrying a plurality of orifices, each said template orifice being aligned with a respective one of an intend product position of said loading station;

wherein the top face of said template operates with said slidable gating and indexing plate to selectably release product to said loading station;

a second hanger structure attached to two opposing interior walls of said housing; and wherein said plurality of entrance chutes structure is manually insertable onto and removable from said second hanger structure;

wherein said plurality of entrance chutes each having an entranceway and an exitway are arranged in said predetermined matrix pattern; and wherein each said chute extends upward through a respective one of said product bin orifices to have its entranceway always within said product bin structure; and wherein said slidable gating and indexing plate includes:

a shuttle plate positioned below said entrance chute exitways, said shuttle plate carrying a plurality of orifices in said predetermined matrix pattern and operating in a horizontal plane to index one product unit per orifice per operation;

a pair of juxtaposed guided side bars positioned adjacent opposing interior walls of said housing;

wherein said shuttle plate is manually insertable to be held by and between said pair of guided side bars and manually removable therefrom;

two pairs of guides, one pair extending from each of said opposing interior walls of said housing to which said guided side bars are adjacently positioned;

wherein each said guided side bar is positioned to slide on a respective pair of guides whereby said guide bars and said shuttle plate carried therebetween can move in an oscillating motion between said opposing interior walls; and a drive mechanism attached to one of said guided side bars for driving said guided side bars and said shuttle plate in said oscillating motion.

8. The dedicated feeder of claim 7 wherein said mechanism for imparting a vertical reciprocating motion to said product bin includes:

a product bin support plate holding said bin and extending in a plane parallel to the plane of the top of said housing;

a pair of footplates positioned at opposite ends of said bin support plate and carrying said bin support plate and said bin thereon between;

two pairs of vertically operating rods connected, one pair each to each of said respective footplates, said operating rod pairs being driven to oscillate in tandem vertically to move said respectively connected footplate; and a crank drive connected to each of said operating rod pairs to operate said operating rod pairs in unison.

9. The dedicated feeder of claim 8 wherein said crank drive includes a separate crank shaft connected to each respective pair of operating rods, said crank shaft having a separate offset connection for each operating rod; and also including a power mechanism for driving each said crank shaft in unison.

10. The dedicated feeder of claim 9 wherein said entrance chute profiles, said shuttle plate orifice profiles and said template orifice profiles are contoured for the specific product profile.

11. The dedicated feeder of claim 10 wherein said entrance chutes, said shuttle plate orifices and said template orifices carry a friction reducing coating.

12. The dedicated feeder of claim 2 wherein said release guide structure is a structural member containing a plurality of release chutes, wherein the entranceways of said release chutes open upon an upper face of said release chute's structural member, said entranceways of said release chutes and said upper face of said release chute structural member operating with said plate in said indexing operation, said release chute structural member being manually insertable into and removable from said housing below said plate.

13. A dedicated feeder for delivering pharmaceutical product to a loading station for delivering simultaneously a plurality of individual ones of said product in a predetermined matrix pattern to said loading station, comprising:

a housing positionable over said loading station;

a product bin located at the top of said housing and carrying a plurality of orifices in its bottom in said predetermined matrix pattern, said orifices being sized to pass a single product at a time;

a crank mechanism for imparting a vertical motion to said bin for promoting said individual ones of said product to drop through said bin orifices, said crank mechanism being connected to said housing;

a plurality of entrance chutes each having an entranceway and an exitway and being assembled to mate with said product bin orifices, said entrance chutes being manually insertable and removable from a position in said housing below said product bin and fixed thereto;

a gating and indexing mechanism positioned at the exitway of each entrance chute for simultaneously gating each entrance chute and then simultaneously indexing an individual one of said product from each entrance chute;

an alignment structure for receiving said simultaneously indexed plural ones of said product and depositing same at said loading station in said predetermined matrix pattern; and wherein said gating and indexing mechanism and said alignment structure are manually received to be held within said housing and manually removed therefrom.

14. The dedicated feeder of claim 13 wherein said crank mechanism is positioned within said housing, said crank mechanism being held in a pair of sealed enclosures, each said sealed enclosure being identically configured and being mounted to opposing inside walls of said housing whereof one wall of each said subhousing forms an interior wall of the operating space of said housing; and wherein each said subhousing includes:

a rotatable crank shaft having a pair of offsets along its length and spaced apart, wherein said crank shaft is positioned to rotate within said housing and to be driven from outside said positionable housing;

a pair of operating rods, one connected to a respective one of said crank shaft offsets so as to operate in parallel, said operating rods extending through a wall of said subhousing at a sealed portal;

a foot plate connected to the free ends of said pair of operating rods, said footplate being moved with the movement of said operating rods and said crank shaft; and a carrying structure connecting said footplate to said product bin.

15. The dedicated feeder of claim 14 wherein said carrying structure is a bin support plate extending between said footplate of each said sealed enclosure; wherein said product bin is attached to and extends above and below said bin support plate; and wherein said operating rods and said crank shaft's movements cause said product bin to vibrate in a vertical plane.

16. The dedicated feeder of claim 15 wherein said gating and indexing mechanism includes:

a reciprocating drive structure positioned outside of said housing;

two pairs of guides extending in pairs towards each other from opposing interior walls of said housing;

a pair of cavities, one cavity in each said opposing wall from which each pair of guides extend, a pair of said guides extending into a respective one of said cavities;

a pair of guided bars, one each said bar being mounted on one of said pair of guides and being oriented to move into and out of a respective one of said cavities; and a shuttle plate mounted between said pair of guided bars and manually mounted thereon, said shuttle plate carrying a plurality of orifices in the pattern of the exitways of said plurality of entrance chutes, the profile of each shuttle plate orifice being sized to accept but a single product at a time.

17. The dedicated feeder of claim 13 also including a hanger structure on the interior walls of said housing, said hanger structure accepting the manual mounting, positioning and removal of said plurality of entrance chutes between said product bin and said gating and indexing mechanism.

18. The dedicated feeder of claim 13 wherein said gating and indexing mechanism includes a shuttle plate which is manually mountable and removable from said mechanism.

19. The dedicated feeder of claim 13 wherein said alignment structure is selected from the class of: a template carrying a plurality of orifices, one orifice for each product of said matrix pattern; and a plurality of release chutes one release chute for each product of said matrix pattern.

20. The dedicated feeder of claim 13 wherein the orifices of said product bin, the passageways of said plurality of entrance chutes, the surfaces of said gating and indexing mechanism, and the surfaces of said alignment structure which contact product are each contoured and each coated with a friction reducer to promote the steady and continuous flow of product.

* * * * *